US010176669B2

(12) United States Patent
Hsu

(10) Patent No.: US 10,176,669 B2
(45) Date of Patent: Jan. 8, 2019

(54) ELECTRONIC GAMING SYSTEM ADAPTED FOR SIMULTANEOUS USE OF MULTIPLE USERS

(71) Applicant: Tien-Shu Hsu, Taichung (TW)

(72) Inventor: Tien-Shu Hsu, Taichung (TW)

( * ) Notice: Subject to any disclaimer, the term of this patent is extended or adjusted under 35 U.S.C. 154(b) by 323 days.

(21) Appl. No.: 15/270,473

(22) Filed: Sep. 20, 2016

(65) Prior Publication Data

US 2017/0294071 A1 Oct. 12, 2017

(30) Foreign Application Priority Data

Apr. 8, 2016 (TW) ..... 105111030 A

(51) Int. Cl.
*G07F 17/32* (2006.01)

(52) U.S. Cl.
CPC ..... *G07F 17/323* (2013.01); *G07F 17/3218* (2013.01); *G07F 17/3241* (2013.01); *G07F 17/3246* (2013.01); *G07F 17/3272* (2013.01)

(58) Field of Classification Search
CPC ..... G07F 17/34; G07F 17/3225
See application file for complete search history.

(56) References Cited

U.S. PATENT DOCUMENTS

2004/0162135 A1* 8/2004 Flanagan-Parks ..... G06Q 20/18 463/25
2009/0075724 A1* 3/2009 Breeding ..... G07F 17/32 463/25
2015/0326639 A1* 11/2015 Nelson ..... H04L 63/0428 713/168

FOREIGN PATENT DOCUMENTS

CN 104813358 A 12/2015
CN 105188865 A 12/2015
WO WO 98/51384 * 11/1998 ..... A63F 9/22

* cited by examiner

*Primary Examiner* — Robert T Clarke, Jr.
(74) *Attorney, Agent, or Firm* — Muncy, Geissler, Olds & Lowe, P.C.

(57) ABSTRACT

An electronic gaming system adapted for the use of multiple users is connectable to a casino management system, is connected to the casino management system via a game interface card, performs data exchange according to an internal casino management system protocol, and allows data exchange between the game interface card and a game server according to a public gaming machine communication protocol. Through a network connection interface of the game server, the electronic gaming system may be used by a plurality of players through wireless connection, and is connected to a mobile member database for logging and comparing member data. The data of the game server is transmitted to the casino management system via the game interface card. Thus, the players are allowed to simultaneously connect to the game server to play games and transmit data to the casino management system for further control.

5 Claims, 4 Drawing Sheets

ELECTRONIC GAMING SYSTEM ADAPTED FOR SIMULTANEOUS USE OF MULTIPLE USERS

FIELD OF THE INVENTION

The present invention relates to a gaming machine, and particularly to an electronic gaming system adapted for simultaneous use of multiple users.

BACKGROUND OF THE INVENTION

FIG. 1 show architecture of a conventional electronic gaming machine. A casino management system 1, as the hub for operating a casino, manages and monitors operations of all electronic gaming machines 2 in the casino, and records accounting information of deposit and withdrawal as well as log information of members. In addition to preventing fraudulent practice of related personnel, the casino management system 1 also serves as a critical medium for audit, control and taxation of authorities. Each electronic gaming machine 2 includes a game interface card 3, a game host 4, a bill machine 5 and a ticket machine 6.

In general, a casino management system provider has its own internal protocol for a casino management system used internally, and contents of such internal communication protocol are not made public. To allow connections of electronic gaming machines of different brands and manufactures with the casino management system 1, each electronic gaming machine 2 is installed with the game interface 3, which is manufactured by the casino management system provider and capable of data exchange with the casino management system 1. The main function of the game interface card 3 is to perform conversion between the internal casino management system protocol and the public communication protocol in order to transmit data. A public protocol, such as Slot Accounting System (SAS), SuperSAS, Game to System (G2S), QCOM and X-series protocols, is usually adopted among the game host 4, the bill machine 5, the ticket machine 6 and the game interface card 3. The SAS protocol is one of the most commonly applied communication protocols. Further, the Casino Management System (CMS) protocol is usually used between the game interface card 3 and the casino management system 1. The function of the game interface card 3 is to convert the data of the electronic gaming machine 2 to be transmitted from the public communication protocol to the internal casino management system protocol, so as to ensure that the data is correctly transmitted to the casino management system 1.

Before and after a player operates the electronic gaming machine 2, bill deposit and ticket withdrawal operations using the bill machine 5 and the ticket machine 6 need to be performed. The bill machine 5 allows the user to deposit cash or an electronic gift card into the electronic gaming machine 2 to convert the cash or electronic gift card into points or a cash amount. The ticket machine 6 allows the user to print the points or cash amount in the electronic gaming machine 2 into an electronic ticket that can then be used for gift exchange or converted to cash.

The above conventional electronic gaming machine 2 can only be operated by one single person, and each electronic gaming machine 2 can only be used by one single person at the same time, hence offering limited commercial effects. Due to a limited venue area of a casino, or a limited number of machines as regulated by authorities, only a limited number of machines can be accommodated. Thus, there is a need for a solution for casino entrepreneurs to allow more players to play at the same time using the limited number of machines without causing crowdedness. To solve the issue of a crowded venue, for example, the China Patent Publication Nos. CN104813358A and CN105188865A, related applications of the same applicant, primarily disclose technologies that allow a player to resume a game of an electronic gaming machine (EGM) on a mobile device and to continue playing the game on the mobile device.

The China Patent Publication No. CN104813358A, discloses technical features of transferring game experiences, and displaying options, related dialogues and accounting data, in paragraph [0047]: the player may resume the game 120 by using the mobile device 110 after the player leaves the proximity of the EGM 130 (i.e., continuing the game dialogue in a cross-platform manner). In some implementation solutions, the game 120 may be transferred from the mobile device 110 back to the EMG 130. The China Patent Publication No. CN105188865A primarily discloses technical features of transferring an image of a gaming machine to a mobile device of a player.

The technical features of the above disclosures focus on the connection and data transmission between the mobile device and the gaming machine to prevent errors during data transfer, hence satisfying the requirement of resuming the game as the player changes the game venue. However, directly relocating the entire game to the mobile device not only faces certain issues of errors in data transmission and user accounts, but may easily generate loopholes and be exposed to risks of being hacked. Thus, the above disclosures have questionable system safety and may not be extensively adopted.

SUMMARY OF THE INVENTION

Therefore, it is a primary object of the present invention to disclose an electronic gaming system adapted for the use of multiple users, so that multiple user may still play a game under the premise of a limited number of gaming machines.

To achieve the above object, the present invention provides an electronic gaming system adapted for simultaneous use of multiple users. The electronic gaming system adapted for simultaneous use of multiple users includes a game interface card and a game server. The game interface card is connected to a casino management system, and data exchange between the game interface card and the casino management system is performed according to an internal Casino Management System (CMS) protocol.

When the game server is connected to the game interface card, and data exchange is performed between the game interface card and the game server according to a public gaming machine communication protocol. The game server includes a network connection interface, a processing unit, a mobile member database and a mobile member accounting database. The network connection interface is connectable to a plurality of player devices by a wireless network, and is connected to the mobile member database for logging and comparing mobile member data. The processing unit transmits data of the game server to the casino management system via the game interface card.

Accordingly, the game server of the present invention includes a network connection interface and may be used by multiple players through wireless connection. The mobile member data and accounting data required for the connection of multiple players may be respectively stored in the mobile member database and the mobile member accounting database, and be transmitted to the casino management system via the same game interface card by the processing unit. More specifically, the present invention provides a game server adapted for simultaneous gaming of multiple players, and accounting data of different players is transmitted to the casino management system via the same game interface card. Thus, regardless of the number of players playing on mobile devices, the same game interface card is used from the perspective of the casino management system, hence achieving the requirement of simultaneous use of multiple players.

The game server consolidates the data of multiple players, e.g., accounting data, game scores and betting amounts, and transmits the data to the casino management system via the game interface card. Thus, from the perspective of the casino management system, without modifying or setting the system, the game server of the present invention is capable of directly connecting to the casino management system via the game interface card, and accordingly allows a plurality of players to simultaneously play games to satisfy application requirements. Compared conventional technologies, the present invention is free from issues caused by data transmission between a player device connecting to an electronic gaming machine (EGM), and is capable of enhancing system security to be extensively applied.

DETAILED DESCRIPTION OF THE PREFERRED EMBODIMENTS

Details of the present invention are given with the accompanying drawings below.

Figure 1:
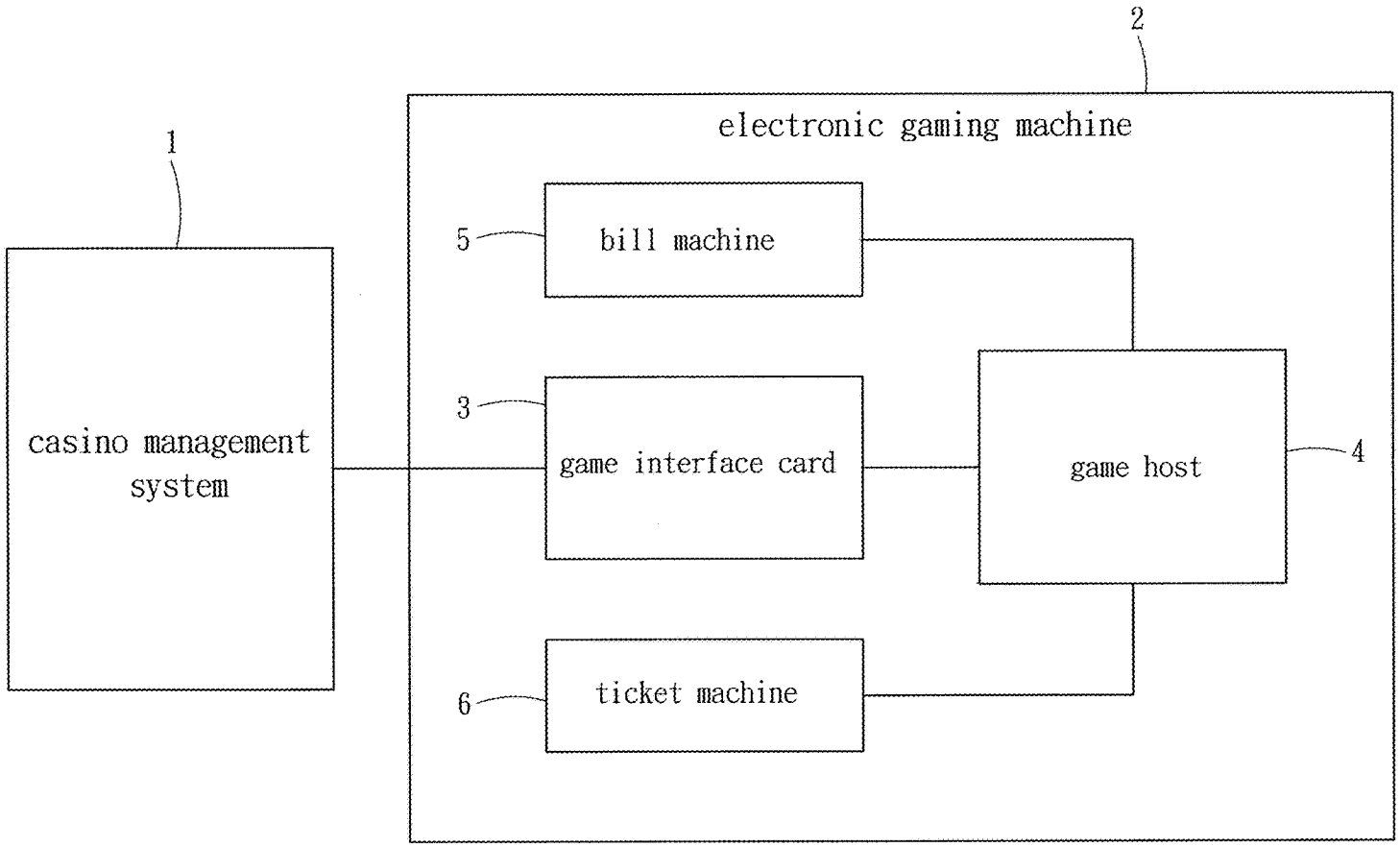
FIG. 1 is a structural diagram of a conventional electronic gaming machine.
Figure 2:
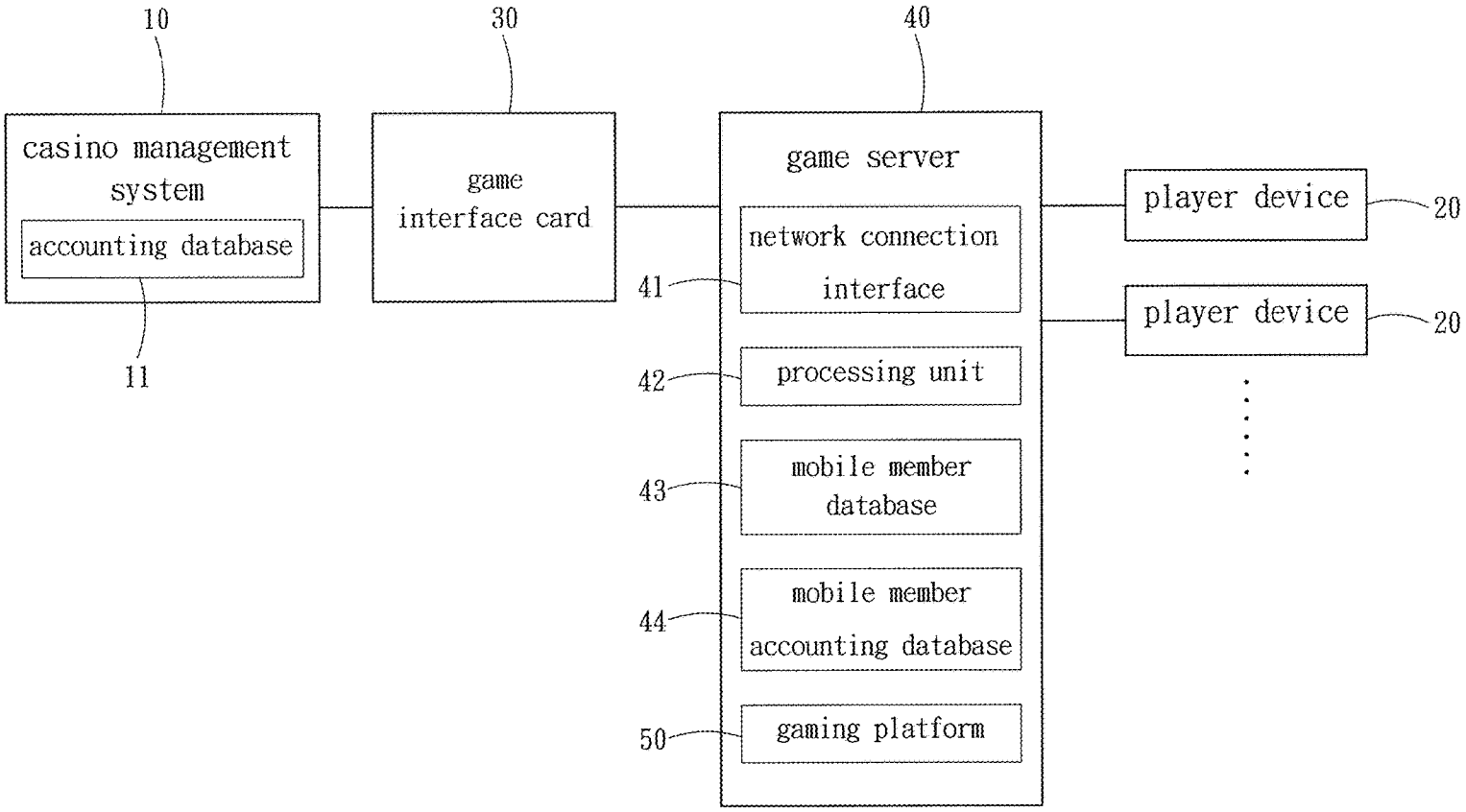
FIG. 2 is a first embodiment of the present invention.

Referring to FIG. 2 showing an electronic gaming system according to a first embodiment of the present invention, the electronic gaming system includes a game interface card 30 and a game server 40. The game interface card 30 is connected to a casino management system 10, and data exchange is performed between the game interface card 30 and the casino management system 10 according to an internal casino management system (CMS) protocol.

The game server 40 is connected to the game interface card 30. Data exchange is performed between the game interface card 30 and the game server 40 according to a public gaming machine communication protocol. For example, the public gaming machine communication protocol is one selected from the group consisting of the Slot Accounting System (SAS), SuperSAS, Game to System (G2S), QCOM and X-series protocols. The game server 40 includes a network connection interface 41, a processing unit 42, a mobile member database 43 and a mobile member accounting database 44. The network connection interface 41 is connectable to a plurality of player devices 20 by a wireless network, and is connected to the mobile member database 43 for logging and comparing mobile member data. The processing unit 42 transmits data of the game server 40 to the casino management system 10 via the game interface card 30 to perform data transmission.

As previously described, the game server 40 includes the network connection interface 41, and may be used by multiple players through wireless connection. The mobile member data and accounting data required for the connection of multiple players may be respectively stored in the mobile member database 43 and the mobile member accounting database 44, and transmitted to the casino management system 10 via the same game interface card 30 by the processing unit 42.

The game server 40 may further include a gaming platform 50, which is for the players to respectively log in through the player devices 20 to play games. More specifically, the player devices 20 may be connected to the network connection interface 41 via the wireless network and logged into the game server 40. The mobile member data and accounting data of the players is stored in the mobile member database 43 and the mobile member accounting database 44, respectively.

Thus, the present invention allows the multiple players to simultaneously log into the game server 40 through the player devices 20 to play games on the gaming platform 50. For example, the player devices 20 may be smart mobile devices such as smart phones and tablet computers. The data generated includes the mobile member data and accounting data of these players, and may be transmitted to the casino management system 10 via the game interface card 30 by the processing unit 42, so as to allow the casino management system to 10 centrally manage the mobile member data and accounting data of these players.

Figure 3:
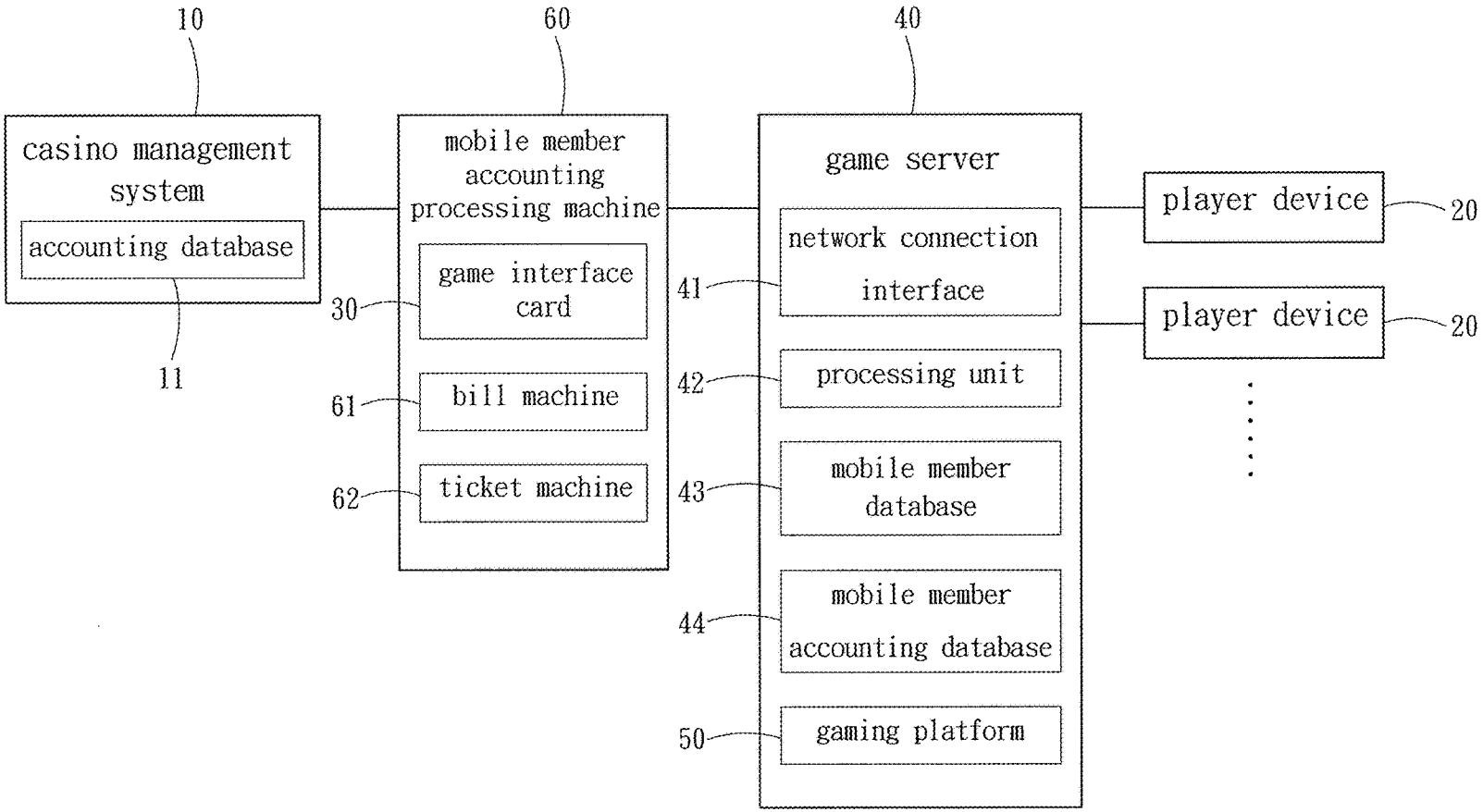
FIG. 3 is a second embodiment of the present invention.

Referring to FIG. 3 showing a second embodiment of the present invention, a mobile member accounting processing machine 60 connected to the casino management system 10 and the game server 40 is further included. The game interface card 30 is provided at the mobile member accounting processing machine 60, which may be operated by the players for accounting operations including deposit and withdrawal after the players are logged in.

The mobile member accounting processing machine 60 may include a bill machine 61. The bill machine 61 allows the players to deposit cash or electronic tickets into the mobile member accounting database 44. After the players deposit using the bill machine 61, the mobile member accounting processing machine 60 transmits associated accounting data to an accounting database 11 of the casino management system 10 and the mobile member accounting database 44, so as to allow the casino management system 10 and the game server 40 to fully learn the associated accounting data.

The mobile member accounting processing machine 60 may further include a ticket machine 62. The ticket machine 62 allows the players to transfer and print the amounts from their accounts in the mobile member accounting database 44 into electronic tickets. After the players transfer and print the amounts from their accounts, the mobile member accounting processing machine 60 transmits the associated accounting data to the accounting database 11 and the mobile member accounting database 44, so as to similarly allow the casino management system 10 and the game server 40 to fully learn the associated accounting data.

Figure 4:
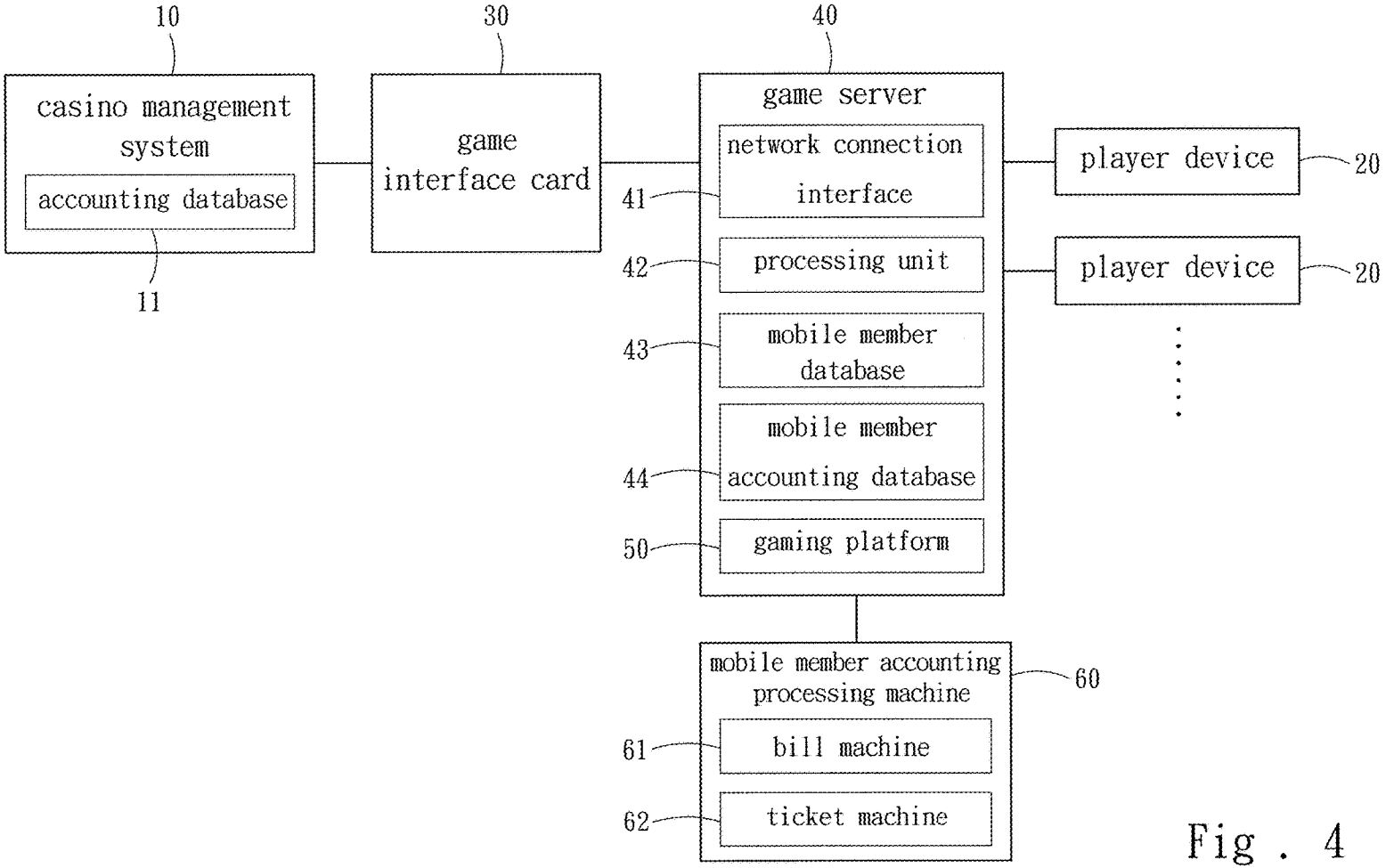
FIG. 4 is a third embodiment of the present invention.

Referring to FIG. 4 showing a third embodiment of the present invention, a mobile member accounting processing machine 60 that is disposed independently and connected to the game server 40 is further included. The mobile member accounting processing machine 60 allows the players to perform accounting operations such as deposit and withdrawal after the players are logged in. Similarly, the mobile member accounting processing machine 60 may include a bill machine 61, which allows the players to deposit cash or electronic tickets into the mobile member accounting database 44. After the players deposit using the bill machine 61, the mobile member accounting processing machine 60 transmits associated accounting data to the accounting database 11 of the casino management system 10 and the mobile member accounting database 44.

The mobile member accounting processing machine 60 may further include a ticket machine 62, which allows the players to transfer and print the amounts from their accounts in the mobile member accounting database 44 into electronic tickets. After the players transfer the amounts from their accounts, the mobile member accounting processing machine 60 transmits the associated accounting data to the accounting database 11 and the mobile member accounting database 44. In the embodiment, the mobile member accounting processing machine 60 is not directly connected to the casino management system 10, and so the associated accounting data is transmitted to the casino management system 10 by the game server 40 on behalf of the mobile member accounting processing machine 60.

As described, with the game server of the present invention, multiple players can be simultaneously connected for gaming through the network connection interface. The mobile member data and accounting data required by these players may be respectively stored in the mobile member database and the mobile member accounting database, and is transmitted by the processing unit to the casino management system via the same game interface card. More specifically, the present invention provides a game server adapted for simultaneous gaming of multiple players, and the accounting data of different players is transmitted to the casino management system via the same game interface card. Regardless of the number of players using mobile devices, from the perspective of the casino management system, the same game interface card is used, thereby satisfying the application requirement of multiple players.

What is claimed is:

1. An electronic gaming system adapted for simultaneous use of multiple users, connectable to a casino management system, comprising:

a game interface card, connected to the casino management system, data exchange between the game interface card and the casino management system performed according to an internal casino management system (CAS) protocol;

a game server, connected to the game interface card, data exchange between the game interface card and the game server performed according to a public gaming machine communication protocol, the game server comprising a network connection interface, a processing unit, a mobile member database and a mobile member accounting database, wherein the network connection interface is connectable to a plurality of player devices by a wireless network and is connected to the mobile member database to perform logging and comparing mobile member data, and data of the game server is transmitted to the casino management system via the game interface card by the processing unit to perform data transmission; and a mobile member accounting processing machine connected to the casino management system and the game server, wherein the game interface card is disposed at the mobile member accounting processing machine, and the mobile member accounting processing machine allows the players to perform accounting operations of deposit and withdrawal after the players are logged in.

2. The electronic gaming system adapted for simultaneous use of multiple users of claim 1, wherein the game server further comprises a gaming platform, which allows a plurality of players to respectively log in through the player devices to play games.

3. The electronic gaming system adapted for simultaneous use of multiple users of claim 1, wherein the mobile member accounting processing machine comprises a bill machine that allows the players to deposit cash or electronic tickets into the mobile member accounting database, and the mobile member accounting processing machine transmits associated data to an accounting database of the casino management system and the mobile member accounting database after the players deposit using the bill machine.

4. The electronic gaming system adapted for simultaneous use of multiple users of claim 1, wherein the mobile member accounting processing machine comprises a ticket machine that allows the players to transfer and print amounts from their accounts in the mobile member accounting database into electronic tickets, and the mobile member accounting processing machine transmits associated accounting data to an accounting database of the casino management system and the mobile member accounting database after the players transfer and print the amounts from their accounts.

5. The electronic gaming system adapted for simultaneous use of multiple users of claim 1, wherein the public gaming machine communication protocol is one selected from the group consisting of Slot Accounting System (SAS), Super-SAS, Game to System (G2S), QCOM and X-series protocols.

* * * * *